US005595542A

United States Patent [19]

Jäger

[11] Patent Number: 5,595,542

[45] Date of Patent: Jan. 21, 1997

[54] MATERIAL FILLED PLASTIC BOWLING PIN

[76] Inventor: Arnold Jäger, Gehrbergsweg 6, 31303 Burgdorf, Germany

[21] Appl. No.: 459,118

[22] Filed: Jun. 2, 1995

[30] Foreign Application Priority Data

Jul. 28, 1994 [DE] Germany ..... 44 26 729.0

[51] Int. Cl.[6] ..... A63K 9/00

[52] U.S. Cl. ..... 473/118; 473/119

[58] Field of Search ..... 473/118, 119, 473/120, 121, 124; 273/167 R, 72 R, 72 A, 67 C; 482/109

[56] References Cited

U.S. PATENT DOCUMENTS 3,229,977 1/1966 Guglielmo, Sr. ..... 473/119

FOREIGN PATENT DOCUMENTS 884983 12/1961 United Kingdom ..... 473/119

*Primary Examiner*—William M. Pierce

*Attorney, Agent, or Firm*—Robert W. Becker & Associates

[57] ABSTRACT

A plastic pin, such as a bowling pin, for bowling lanes. The pin has a hard shell that surrounds a core of cellular and/or porous material, preferably a thermoplastic material. The interior of the shell has at least one partition that divides the hollow interior of the shell.

13 Claims, 2 Drawing Sheets

MATERIAL FILLED PLASTIC BOWLING PIN

BACKGROUND OF THE INVENTION

The present invention relates to a plastic pin, including a so-called bowling pin, for bowling lanes. The pin has a hard shell that surrounds a core of cellular and/or porous material, preferably a thermoplastic material.

During the manufacture of such pins, the shell is first produced, for example by blow molding. The material for the core, to which has been added an expanding agent, is then introduced into the shell, and in particular from below, i.e. from the base of the shell, in order in this manner to fill the shell with expanded material. Although such pins can be made true to shape, difficulties often arise with respect to the level of the center of gravity, which is significant with respect to the tipping characteristic of the pin.

It is therefore an object of the present invention to improve a pin of the aforementioned general type in such a way that the level of the center of gravity of the pin body can be affected in a simple manner.

This object, and other objects and advantages of the present invention, will appear more clearly from the following specification in conjunction with the accompanying schematic drawing, which is a partially broken away view of one exemplary embodiment of the inventive pin.

SUMMARY OF THE INVENTION

The pin of the present invention is characterized primarily in that the interior of the shell is provided with at least one transverse wall or partition such that at least two chambers are formed above one another within the shell. These chambers can then be filled as desired with porous and/or cellular material or even with other materials, with it being expedient to use materials having different specific weights. It would also be possible to fill, for example, one chamber while leaving a second chamber unfilled.

Preferably merely a single partition is provided, and in particular in the vicinity of the head of the pin, so that, for example, by filling the upper chamber with a material having a lighter specific weight, it is possible to affect the tendency of the pin to tip, i.e. the level of its center of gravity.

Although the partitions can be continuous to thereby provide for complete partitioning, it is nonetheless preferable to provide the partitions with small holes that can then serve as venting means when the pertaining chambers are filled with a material that forms a cellular and/or porous core.

Further specific features of the present invention will be described in detail subsequently.

DESCRIPTION OF PREFERRED EMBODIMENTS

Figure 1:
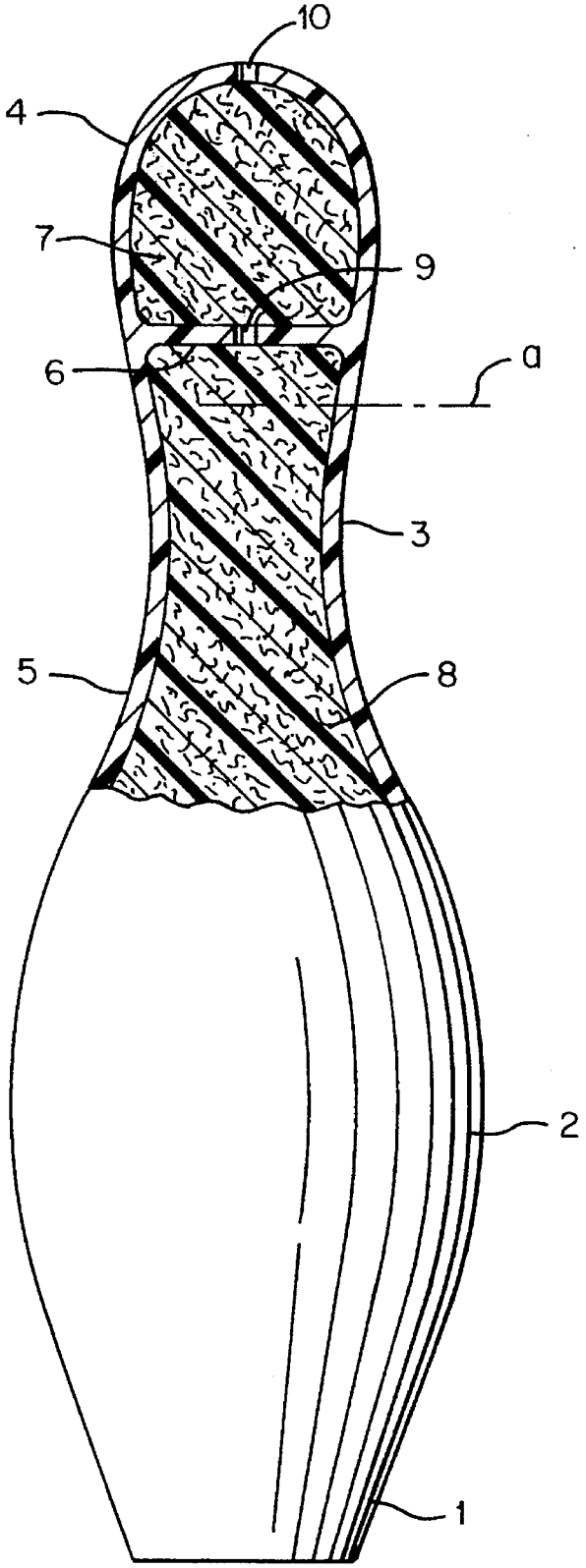
FIG. 1 is a cut away view of the bowling pin in accordance with the present invention.
Figure 2:
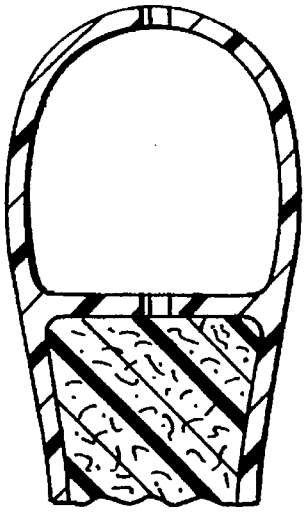
FIG. 2 shows an alternate embodiment of the instant invention with an unfilled head portion.
Figure 3:
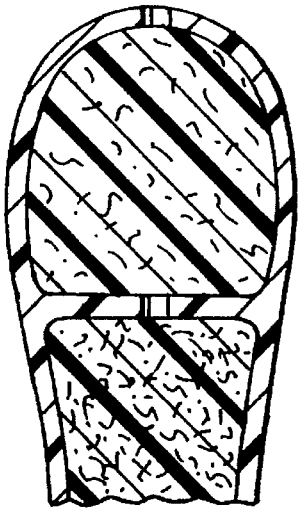
FIG. 3 shows another embodiment where the material in the head portion is of different specific weight.
Figure 4:
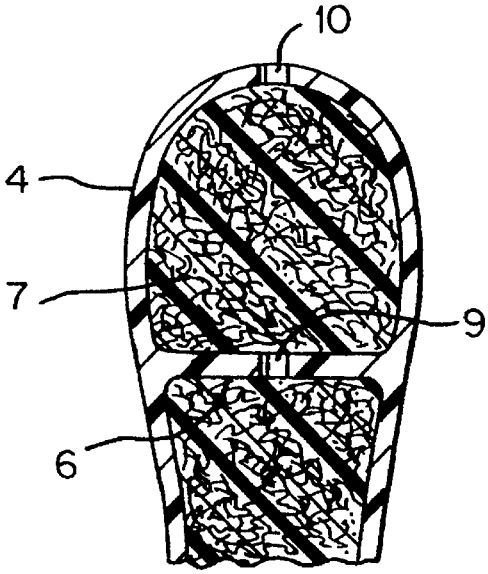
FIG. 4 shows the pin filled with reinforcing fiber.

Referring now to the drawing in detail, the illustrated pin, in a customary manner, is provided above a base 1 with a barrel portion 2, a neck 3 and a head 4. In other words, in the region of the neck 3 the outer diameter of the pin is reduced.

The contour of the pin is determined by its shell 5, which is made of a hard, impact resistant plastic, for example one having a polyamide base. The shell 5 is made, for example, by blow molding and has a wall thickness of about 3 to 6 mm.

In the neck region, and in particular in the region between the head 4 and the neck 3, the shell 5 has a horizontal transverse wall or partition 6 that extends through the hollow interior of the shell 5 such that it divides the interior of the shell 5 into an upper chamber 7 and a lower chamber 8. However, the partition 6 is not continuous, but rather is provided with a central hole 9 having a diameter of about 5 mm. Similarly, a hole 10 is provided in the middle of the upper end of the head 4; the hole 10 can have a diameter of about 5 mm.

The partition 6 is disposed at such a level that the chamber 7 has a volume of about 50–100 $cm^3$. It is therefore also possible to dispose the partition 6 at the level indicated by the dot-dash line "a".

After the shell 5 has been produced, a plastic to which has been added expanding agent and which has a specific weight of about 0.4–0.8 $kg/dm^3$, preferably having a polypropylene base, is introduced into the chamber 8 via the base 1 through a hole provided there. The expansion of the material then takes place in the chamber 8. In so doing, the air that is displaced can escape upwardly through the holes 9 and 10. Glass fibers or other reinforcing fibers can be mixed with the plastic.

Under these conditions, the chamber 7 can remain unfilled. However, it is also possible to fill this additional chamber at the upper end of the pin with a material that forms expanded material and cells but that generally has a specific weight of only 0.1–0.2 $kg/dm^3$, in other words, a specific weight that is only about ¼ that of the material that fills the chamber 8.

Although generally only one partition 6 is provided, it would also be possible to provide a further partition in order to divide the shell 5 into three chambers. These chambers should also communicate with one another by small holes provided in the partitions for venting reasons.

It should be noted that the aforementioned holes 9, 10 do not, with the diameter values that are provided, allow for any significant amount of the expanding material to pass therethrough. Rather, these holes restrict the passage of the expanding material from one chamber to the other while at the same time allowing air to escape in an unobstructed manner.

The present invention is, of course, in no way restricted to the specific disclosure of the specification and drawing, but also encompasses any modifications within the scope of the appended claims.

What I claim is:

1. A plastic bowling pin, for bowling lanes, comprising:

a hard shell having a hollow interior that contains material selected from the group consisting of cellular and porous material; and at least one partition disposed within said shell and dividing said hollow interior of said shell into at least two chambers, said at least one partition being provided with a single centrally disposed first hole extending therethrough as a venting hole.

2. A pin according to claim 1, wherein said partition extends perpendicular to a main axis or axis of rotation of said pin.

3. A pin according to claim 1, wherein said pin is provided with a head and a neck, and wherein said at least one partition is disposed in the region of said head and said neck.

4. A pin according to claim 3, which includes a single partition that is disposed in a transition region between said head and said neck.

5. A pin according to claim 3, wherein chambers that are disposed in the vicinity of said head of said pin remain unfilled with said cellular and/or porous material.

6. A pin according to claim 3, wherein chambers that are disposed in the vicinity of said head of said pin are filled with a cellular and/or porous material having a specific weight that is less than that of material disposed in a chamber that is disposed in the vicinity of a base of said pin.

7. A pin according to claim 6, wherein the ratio of said specific weights of said material ranges from about 1:2 to 1:8.

8. A pin according to claim 3, which includes a single partition, wherein said chamber disposed above said partition has a volume of about 50–100 $cm^3$.

9. A pin according to claim 1, wherein said at least one first hole is of such a size that it restricts the passage of material introduced into said shell for forming said cellular and/or porous material through, yet trapped air can escape.

10. A pin according to claim 1, wherein said cellular and/or porous material has added thereto reinforcing fibers.

11. A pin according to claim 10, wherein said reinforcing fibers are glass fibers.

12. A plastic bowling pin, for bowling lanes, comprising:

a hard shell having a hollow interior that contains material selected from the group consisting of cellular and porous material; and at least one partition disposed within said shell and dividing said hollow interior of said shell into at least two chambers, said at least one partition being provided with at least one first hole as a venting hole extending therethrough, and said shell having a head that at an uppermost point has a second vent hole extending therethrough that is disposed on a main axis or axis of rotation of said pin.

13. A pin according to claim 1, wherein said at least one partition is provided with a single centrally disposed first hole.

* * * * *